US005924490A

United States Patent [19]

Stone

[11] Patent Number: 5,924,490

[45] Date of Patent: Jul. 20, 1999

[54] WELL TREATMENT TOOL AND METHOD OF USING THE SAME

[76] Inventor: Roger K. Stone, 1112 Granada, Odessa, Tex. 79763

[21] Appl. No.: 08/925,174

[22] Filed: Sep. 9, 1997

[51] Int. Cl.[6] ..... E21B 21/00; E21B 43/00

[52] U.S. Cl. ..... 166/312; 166/222; 166/304; 166/310; 166/311

[58] Field of Search ..... 166/105, 68, 304, 166/310, 90.1, 300, 311, 312, 325, 327, 72, 112, 222, 371, 372; 507/90

[56] References Cited

U.S. PATENT DOCUMENTS

| | | | |
|---|---|---|---|
| 2,300,348 | 10/1942 | Dana | 166/302 |
| 2,562,458 | 7/1951 | Hartsell | 166/177.3 |
| 4,011,906 | 3/1977 | Alexander et al. . | |
| 4,224,993 | 9/1980 | Huckaby . | |
| 4,267,888 | 5/1981 | Singer | 166/312 |
| 4,279,306 | 7/1981 | Weitz . | |
| 4,440,229 | 4/1984 | Burch | 166/311 |
| 4,681,167 | 7/1987 | Soderberg . | |
| 4,716,960 | 1/1988 | Eastlund et al. | 166/60 |
| 4,790,375 | 12/1988 | Bridges et al. | 166/60 |
| 4,846,279 | 7/1989 | Bruce | 166/310 |
| 4,995,462 | 2/1991 | Sask et al. . | |
| 5,056,599 | 10/1991 | Comeaux et al. . | |
| 5,246,074 | 9/1993 | Ayres | 166/310 |
| 5,282,263 | 1/1994 | Nenniger . | |
| 5,595,243 | 1/1997 | Maki, Jr. et al. | 166/177.2 |

FOREIGN PATENT DOCUMENTS 92-06274 4/1992 WIPO .

*Primary Examiner*—Tamara Graysay
*Assistant Examiner*—Sunil Singh
*Attorney, Agent, or Firm*—Alan J. Atkinson

[57] ABSTRACT

A well treatment tool is installed along the sucker rod string of a well, within the surrounding production tube string. The tool provides for the distribution of a treatment fluid (solvent, etc.) within the fluid being pumped or flowing from the well. The tool receives treatment fluid through the hollow sucker rod string, and distributes the fluid through a valve which is set at a predetermined pressure. When the treatment fluid pumped down the sucker rod string from the surface exceeds the predetermined opening pressure of the valve, the treatment fluid is distributed into the production tube string through one or more passages in the tool. The present tool may be used simultaneously with well production, with fluid (oil, etc.) rising up the production tube string, carrying the treatment fluid therewith. The treatment fluid is thus distributed throughout the local fluid processing system, including pipelines from the well, any initial treatment operations, and any storage tanks. The present tool is particularly well adapted for the treatment of paraffin build-ups within the production tube string of an oil well, but may be used to provide various treatments to other types of wells. The present tool may be used with both pumping wells and flowing (e. g., artesian) wells.

20 Claims, 4 Drawing Sheets

WELL TREATMENT TOOL AND METHOD OF USING THE SAME

BACKGROUND OF THE INVENTION

1. Field of the Invention

The present invention relates generally to tools and equipment used in the oil, gas, and water well industry, and more specifically to a treatment tool which secures in line along the pump actuation or "sucker" rod string in a completed well hole. The treatment tool provides for the distribution and pressure regulation of a solvent or other fluid, which is pumped into the hole through the sucker rod for distribution into the production tube or pipe string. The device may be used to provide a continuous supply of solvent or other fluid to the oil or other fluid being pumped or delivered from the well, while the well remains in continuous operation.

2. Description of the Related Art

Wells drilled in the ground for the drawing of subterranean fluid substances, often encounter various problems with undesirable foreign matter which at least partially blocks the production tube or pipe string of the finished well and obstructs the pumping or flow of the fluid from the well. When this occurs, additional time and expense is encountered as the foreign material is removed from the well and fluid flow resumes.

This is particularly true in the oil industry, where subterranean crude oil deposits generally have less desirable substances mixed therein. One of these substances is called paraffin, a hydrocarbon which hardens to form a wax-like material as it cools. While the crude oil is universally quite warm or even hot at a depth from a few thousand to several thousand feet beneath the surface, it tends to cool as it rises up the production tube string of a producing well. When the paraffin rises to a depth where the ambient temperature is around 160 degrees Fahrenheit, it begins to solidify and adhere to the walls of the production tube string. The problem becomes worse with decreasing temperatures nearer the surface.

The solidifying paraffin will eventually block the oil flow from below, and require treatment of the production string in order to remove the paraffin buildup. This is conventionally done by mechanical means, electrical heating, hot water, and/or solvents introduced into the well. However, the various means of removing the paraffin from the production string generally require that flow from the well (either pumped or free flowing) be stopped while the treatment means is introduced into the well, and the well is treated. For example, chemical treatment using solvents is quite commonly used to remove paraffin buildup, but the chemicals are conventionally forced down the production string, in the opposite direction of pumped or natural flow. Obviously, oil cannot be recovered from the well during the time the chemical is being introduced into the well.

However, even if the paraffin buildup is removed from the production string, paraffin buildup may still occur in the oil processing and storage system after it leaves the well. Anywhere the temperature drops below the critical level of about 160 degrees Fahrenheit, paraffin will begin to harden in the system. Typically, oil leaves the well head to a tank battery, or series of storage tanks. The oil is then processed to remove water and gas mixed therewith, by heating in a heater treater. Paraffin makes it difficult to separate water from the oil, thus requiring additional heat (generally in the form of gas separated from the oil) to produce the desired reaction. Moreover, even if the paraffin is heated to melting in the heater treater, it will still solidify in valves, pipelines, and storage tanks prior to reaching the heater.

Accordingly, a need will be seen for a means of treating a producing well to remove foreign substances therefrom on a continuous basis, without interrupting the output of the well. The foreign substance removal means is particularly needed in the case of wells for oil with paraffin mixed therewith, to dissolve the paraffin and keep it in solution in the oil from a point in the well below the temperature at which it begins to solidify, and throughout the entire pipe and tank system of the oil field. While the present invention is particularly well suited for use in the oil production industry, it may also be adapted for use with other types of subterranean wells. A discussion of the related art of which the inventor is aware, and its differences and distinctions from the present invention, is provided below.

U.S. Pat. No. 4,011,906 issued on Mar. 15, 1977 to Harvey C. Alexander et al. describes a Downhole Valve For Paraffin Control, comprising a non-concentric (axially offset) valve which is assembled as a "sub" or short length of the production tube string. Solvent is forced down the production string to the valve, where a ball check valve is forced from its normally closed position by the pressure of the solvent, to allow the solvent to flow outwardly from the production string to the space between the production string and casing. It will be seen that the forcing of the solvent downwardly through the production string, which is normally used to deliver oil to the surface, requires that the well be shut down during the time that the solvent is being forced into the well. The present valve tool, adapted for inclusion as a "sub" in the sucker rod of the well, allows oil (or other substance being delivered by the well) to continue to flow upwardly through the production tube string without interruption, during treatment of the well. The solvent is carried up through the production tube with the flow of fluid being delivered from the bottom of the well, to flush paraffin or other substances from the production string.

U.S. Pat. No. 4,224,993 issued on Sep. 30, 1980 to Leonard Huckaby describes a Dewaxing Valve For Use In Oil Wells, comprising a valve mounted externally to the production tube, between the production string and the outer casing of the downhole. While the valve mechanism is somewhat different than that of the Alexander et al. valve discussed above, the operation is similar, with the well being shut down during the treatment process.

U.S. Pat. No. 4,279,306 issued on Jul. 21, 1981 to Robert D. Weitz describes a Well Washing Tool And Method, comprising a plurality of resilient packings on a "sub" which secures in line with the production tube string of the well. Pressure causes the central sleeves of the device to extend, thereby compressing the packings against the inner walls of the well casing. Sealing the device against the well casing routes the washing fluid through the perforated casing to wash any loose material away which may surround the outer casing. The fluid returns to the annulus between the casing and production tubing by perforations in the casing above the tool. Again, the well cannot produce oil or other fluid during use of the Weitz tool, as fluid under pressure is being forced downwardly through the production tube string, unlike the present invention where downward fluid flow is only through the hollow sucker rod.

U.S. Pat. No. 4,681,167 issued on Jul. 21, 1987 to Paul B. Soderberg describes an Apparatus And Method For Automatically And Periodically Introducing A Fluid Into A Producing Oil Well. The apparatus includes a valve placed in the downhole, which valve is actuated by pressure and/or movement of the sucker rod therethrough. The valve essentially fills the inside of the production tube string, with actuation either blocking or opening the valve to prevent or allow fluid to flow through the production string. The device operates generally in the manner described above for the other systems of the related art, in that fluid must be pumped downwardly through the production string from time to time in order to flush paraffin or other substances from the production tube string. This of course requires that fluid production from the well be stopped during the time that solvents or other fluids are being forced down the production tube string. While Soderberg states that "Present methods for removing such deposits employ hot oil, water or steam which is generally forced down the annulus between the production string and borehole casing" (column 1, lines 44–47), none of the related art discussed above, including Soderberg, do so. Rather, they force the fluid down the production tube string, rather than down the annulus between the production string and casing or wall of the downhole.

U.S. Pat. No. 4,995,462 issued on Feb. 26, 1991 to David Sask et al. describes a Dewaxing Control Apparatus For Oil Well, comprising a housing installed in line with the production tubing, as in the case of other devices discussed above. Dewaxing solvent or the like is pumped down the annulus between the well casing or wall and the production tubing, with the device blocking further downward flow therepast. The solvent then enters the interior of the production tube string by means of passages through the device, and is flushed back to the surface by means of the upward flow of oil through the interior of the production tube string. This is the only art of that discussed above, which causes the solvent to flow upwardly through the production string, in the manner of the present invention. However, Sask et al. still do not pump the fluid downwardly through the hollow sucker rod, or provide a valve which is installed in the sucker rod rather than the production tube string, as in the present invention. If the Sask et al. valve required removal from the hole, the production tube string would have to be lifted and disassembled at least to the depth of the valve. Such production tube removal would of course also require the removal of the entire sucker rod string before removal of the production tube string could take place. In the present invention, only the sucker rod string would have to be removed from the hole, with the production tube string remaining in place in the hole.

U.S. Pat. No. 5,056,599 issued on Oct. 15, 1991 to Walter B. Comeaux et al. describes a Method For Treatment Of Wells, comprising a telescoping valve which is axially offset from the production tube string, in a configuration somewhat similar to the device of the patent to Huckaby described further above. Comeaux et al. provide an initial balancing pressure in their valve by means of a compressed nitrogen charge, which holds the valve in a closed position until a superior pressure in the well downhole pushes the valve open. The Comeaux valve depends upon pneumatic means and differential pressure for operation, unlike the present well treatment tool, and also requires that production flow from the well be interrupted for the treatment fluid (hot water, solvent, etc.) to be introduced down the production tube string, where the Comeaux et al. valve routes it into the well casing. The present valve routes the solvent down the hollow interior of the sucker rod, where the valve is disposed, and routes the fluid outwardly from the sucker rod into the production tube interior.

U.S. Pat. No. 5,282,263 issued on Jan. 25, 1994 to John E. Nenniger describes a Method Of Stimulating Oil Wells By Pumped Solvent Heated In Situ To Reduce Wax Obstructions. The apparatus used in the method is an electrical resistance heater which is lowered to the bottom of the production tube string of the well. Solvent is then introduced into the well via the production tube string, and heated by the heater. As in all but one of the prior art devices discussed above, production must be stopped when the Nenniger method and apparatus is used in order for the solvent to be pumped into the well, downwardly through the production tube string. Moreover, the Nenniger apparatus and method circulates the solvent outwardly through the conventional passages in the lower end of the production tube string and casing, and into the surrounding geological structure. The Nenniger heater element also precludes the installation of a pump in the well, as it seals against the pump seating nipple at the bottom of the production tube string and takes the position of the pump. Thus, production must be suspended in a pumping well, with the pump and sucker rod removed for installation of the Nenniger apparatus.

Finally, PCT Patent Publication W092/06274 published on Apr. 16, 1992 to John E. Nenniger describes a Method And Apparatus For Well Stimulation. This patent publication corresponds to the U.S. patent to the same inventor, described immediately above, with the same differences and distinctions being noted.

None of the above inventions and patents, either singly or in combination, is seen to describe the instant invention as claimed.

SUMMARY OF THE INVENTION

The present invention comprises a well treatment tool for introducing a solvent fluid or the like to a subterranean well. The tool is particularly adapted for use in removing solidified paraffin buildup from the inner wall of the production tube string of an oil well, but may be used in other well types and treatments as well. The present tool installs concentrically in line in the "sucker rod," or pump actuating rod string, of a well, and receives solvent or other treatment fluid through the hollow core of the sucker rod. A valve, e. g., ball check valve, is provided to preclude unwanted or excessive flow of solvent fluid through the device until a predetermined solvent pressure has been reached, which pressure is controllable from above ground. When adequate pressure is achieved to open the valve, the solvent or other fluid flows from the interior of the hollow sucker rod, outwardly through the tool, and into the interior of the surrounding production tube string, where it is carried upwardly back to the surface along with fluid being pumped or otherwise delivered from the well.

The present well treatment tool is capable of treating a well at any depth, from the very bottom of the well adjacent the pump, to any intermediate depth. The tool may be installed at any point desired along the sucker rod, as a "sub," or shorter unit of the rod string. Preferably, the tool is installed a few hundred feet below the point at which paraffin begins to solidify in the production tube string of an oil well, in order to be flushed upwardly with the oil to dissolve the paraffin buildup thereabove.

It will be seen that the present tool is capable of treating a well from the problem area below ground, through the entire above ground pipeline, initial treatment, and on site storage system. The solvent delivered by the present tool is disseminated from the tool upwardly throughout the downhole production tube, due to the oil being pumped or otherwise delivered from the bottom of the hole. The oil, with the solvent carried therein, continues to keep paraffin in solution throughout its travel through the above ground initial processing and storage tank system. It will be noted that the present tool is not limited to use with a pumping type well, but may also be used with a flowing or artesian well, where no above ground pump is required. The tool may be lowered down the production tube at the end of a sucker rod string, to the depth desired, without connecting the sucker rod string to other components (e. g., pump) therebelow.

Accordingly, it is a principal object of the invention to provide an improved well treatment tool for installing concentrically in line with the sucker rod string of a production subterranean fluid well.

It is another object of the invention to provide an improved well treatment tool which accepts treatment fluid from the hollow core of the sucker rod string, and distributes the fluid into the interior of the surrounding production tube string.

It is a further object of the invention to provide an improved well treatment tool which includes valve means precluding backflow of fluid from the well through the tool.

An additional object of the invention is to provide an improved well treatment tool which is adapted for simultaneous treatment of fluid being delivered from the well during the time the well is producing, without requiring shutdown of the well.

Yet another object of the invention is to provide an improved well treatment tool which is adapted to treat fluid being delivered from the well, from the location of the tool in the well downhole throughout the above ground initial treatment and storage system.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
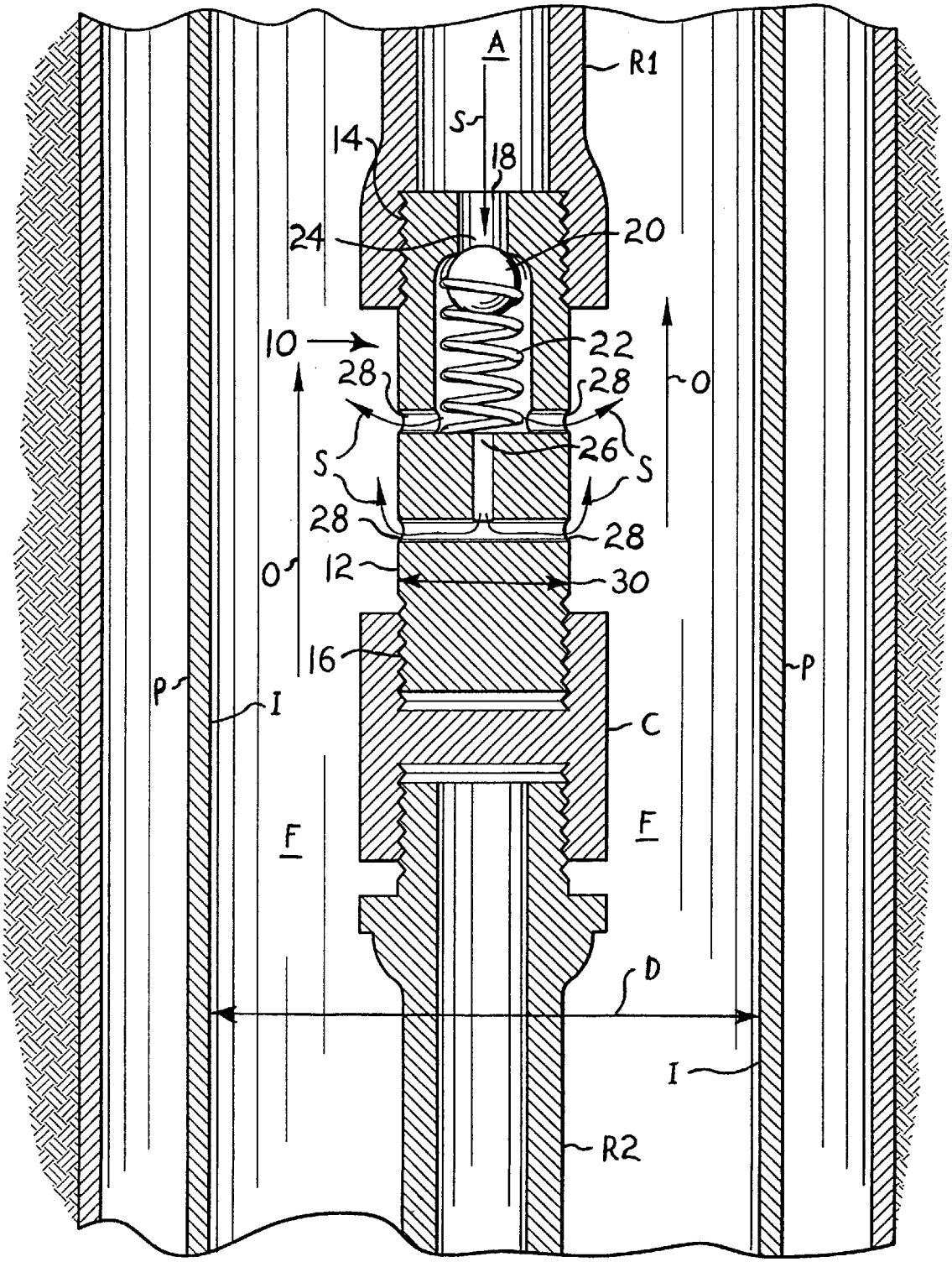
FIG. 1 is an environmental elevation view in section of the present well treatment tool, showing its features and operation.
Figure 2:
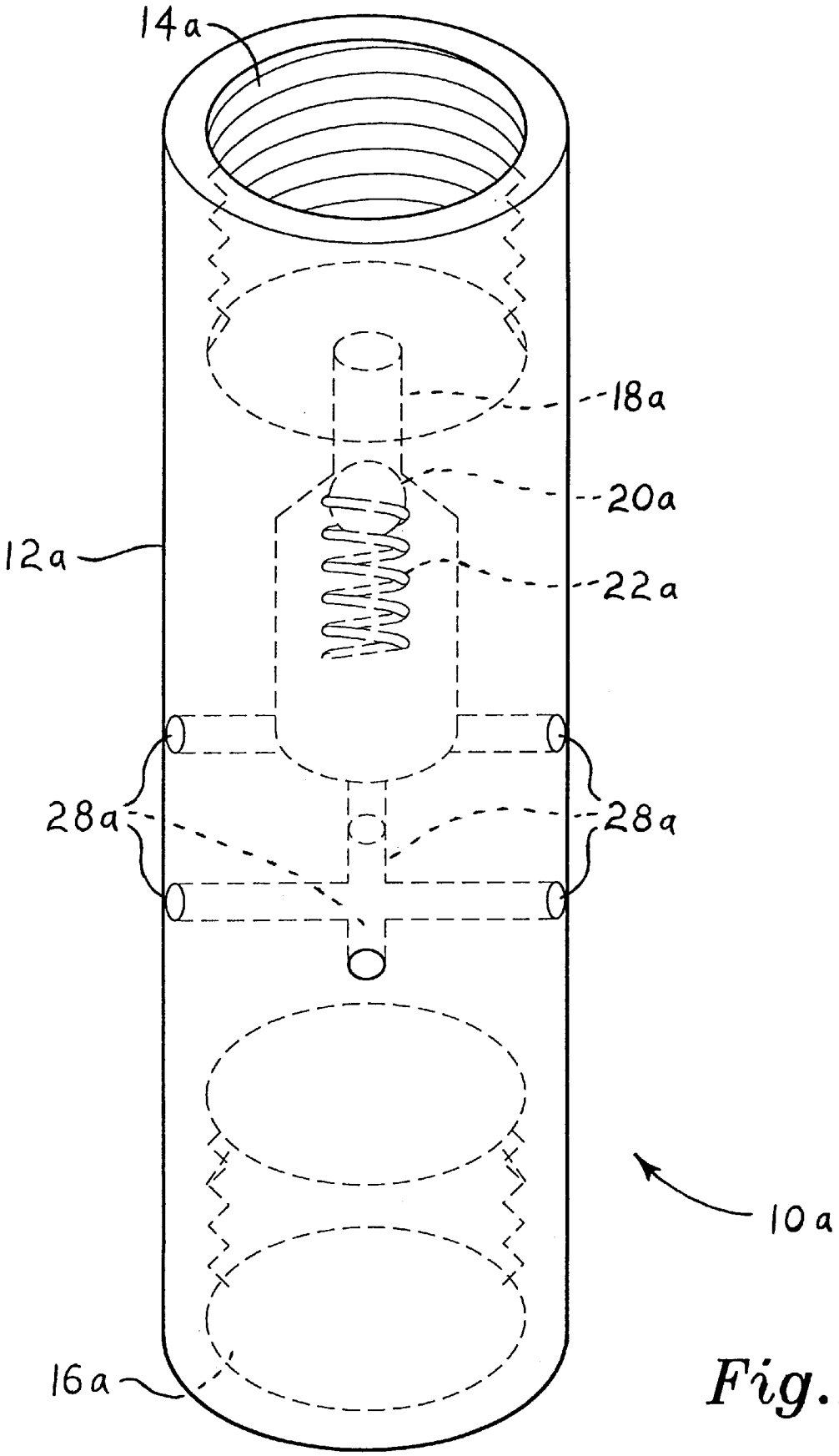
FIG. 2 is a perspective view in section of an alternative embodiment of the present tool, showing its features.

The present invention comprises various embodiments of a well treatment tool, indicated by the reference numeral 10 in FIG. 1 and 10*a* in FIG. 2. The tools 10 and 10*a* are used to deliver a well treatment fluid, such as a solvent indicated by the arrows S of FIG. 1, into the production fluid flow (e. g., oil, indicated by the arrows O of FIG. 1) into the production tube string P.

As discussed in the introduction to the Description of the Related Art, fluids delivered from subterranean wells of various types often have various contaminants or impurities therein, which can contaminate the well and/or above ground initial processing and storage systems in some way or another. An example of this is the oil industry, where subterranean crude oil often includes some fraction of paraffin therein. While the subterranean crude oil is generally sufficiently far beneath the surface that the temperature is relatively high, perhaps two hundred degrees fahrenheit or more, it will cool as it travels up the production tube string P of the well. Paraffin, normally in solution in the crude oil, will begin to precipitate out of solution as it reaches an elevation at or below the melting point of the substance, approximately 160 degrees Fahrenheit (depending upon the specific molecular weight and structure of the paraffin material. As it solidifies, it condenses on the relatively cooler inner walls I of the production tube string P. This paraffin buildup results in a reduction in cross sectional area within the production tube string, which reduces the oil flow within the string and thus the production of the well.

The tool 10 of FIG. 1 has a generally cylindrical body 12, with an externally threaded upper or first end 14 and an opposite externally threaded lower or second end 16. The external threads of the two ends 14 and 16 are configured to mate with the cooperating internal threads of a hollow sucker rod R1, concentrically connected to the upper end 14 of the tool 10, and a similarly threaded coupling C, connected to the lower end 16 of the tool 10. (It will be seen that in the absence of the tool 10, the upper sucker rod R1 may be connected directly to the mating lower sucker rod R2, in order to actuate a downhole pump, in the well configuration shown in FIG. 3 and discussed further below.)

The sucker rod string portions R1 and R2 are generally hollow, with a concentric passage A formed therein. Normally, no fluid is passing through or resident in the passages A; the rods R1 and R2 are hollow in order to reduce the weight of the sucker rod string, which can be considerable in a sucker rod assembly having a length of several thousand feet. However, the central passage A of the hollow sucker rod R1 provides for the delivery of a fluid, such as the solvent S, therethrough to the present well treatment tool 10. The tool 10 includes an axial passage 18 in the upper end 14 thereof, which communicates with and accepts the fluid or solvent S from the upper sucker rod passage A. A normally closed valve, e.g., ball check valve 20, is installed within the tool body 12 to preclude the reverse flow of well fluid, such as oil O, through the tool 10 and upwardly into the sucker rod passage A. (Other types of valves, e. g., poppet, sleeve, etc., may be used as desired.)

It will be recognized that the fluid (oil O, etc.) at some great depth in the well is at an extremely high pressure, with the well fluid O naturally tending to flow from the high pressure area within the production tube string P to the lower pressure area within the interior passage A of the sucker rod S1 (assuming no back pressure of treatment fluid S exists within the interior passage A). Accordingly, a spring 22 is provided to hold the valve 20 in a normally closed position. The spring 22 may be calibrated to provide a predetermined pressure to hold the valve 20 closed, depending upon the depth at which the tool 10 is to be installed. Various calibration means (not shown) , such as a separate threaded screw adjustment, shims or washers beneath the spring 22, etc., may be provided to adjust the spring 22 pressure, as desired.

When treatment fluid S is applied through the sucker rod passage A at sufficient pressure, it forces the check valve 20 open against the spring 22 pressure to flow downwardly through the inlet end 24 and out the outlet end 26 of the valve and out of the tool body 12, by means of one or more radial fluid distribution passages 28 and into the production fluid passage F defined between the inner wall I of the production tube string P and the body 12 of the tool 10. (The inner diameter D of the production tube string P is considerably less than the diameter 30 of the tool 10, with the difference in the tool diameter 30 and production tube internal diameter D defining the production fluid passage F therebetween.) As the lower end 16 of the tool 10 is solid, the treatment fluid S cannot flow downwardly into the lower sucker rod R2.

An alternative embodiment of the tool 10 of FIG. 1 is shown in FIG. 2 as tool 10*a*. The tool 10*a* of FIG. 2 will be seen to closely resemble the tool 10 of FIG. 1, having a generally cylindrical body 12*a*. However, the upper end 14*a* and opposite lower end 16*a* of the tool 10*a* are internally threaded, rather than having the external threads of the upper and lower ends 14 and 16 of the tool 10 of FIG. 1. The tool 10*a* of FIG. 2 could be installed in the sucker rod string R1 and R2 of FIG. 1 in place of the tool 10, merely by installing the internally threaded coupling C to the upper end 14*a* of the tool 10*a*, rather than to the lower end 16 of the tool 10 as shown in FIG. 1, and then connecting the internally threaded lower end 16*a* of the tool 10*a* directly to the externally threaded upper end of the lower sucker rod R2.

It will be seen that another embodiment of the present tool (not shown) could be manufactured with an externally threaded upper end, and an internally threaded lower end, if desired, to eliminate the need for a coupling with the sucker rod connections shown.

Other components of the tool 10*a* of FIG. 2, i. e., the upper end axial passage 18*a*, check valve 20*a* and spring 22*a*, radial passages 28*a*, outer diameter 30*a*, etc., are essentially identical to those components 18, 20, 22, 28, and 30 shown in the tool 10 of FIG. 1. As in the case of the tool 10 of FIG. 1, any practicable number of passages 28*a*in any practicable arrangement, may be provided for the tool 10*a* of FIG. 2.

Figure 3:
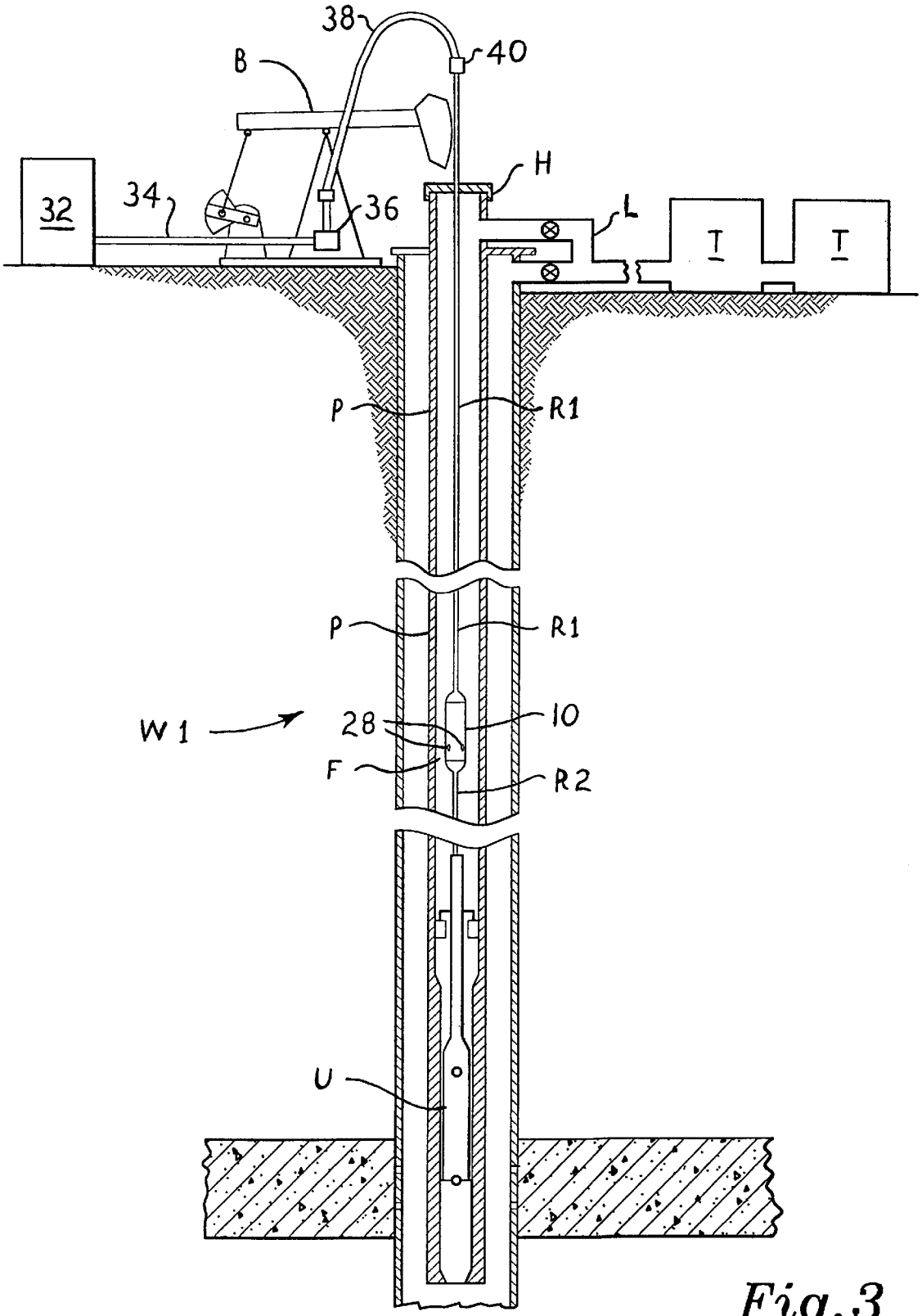
FIG. 3 is an environmental view in section of a pumping well with the present treatment tool installed therein.
Figure 4:
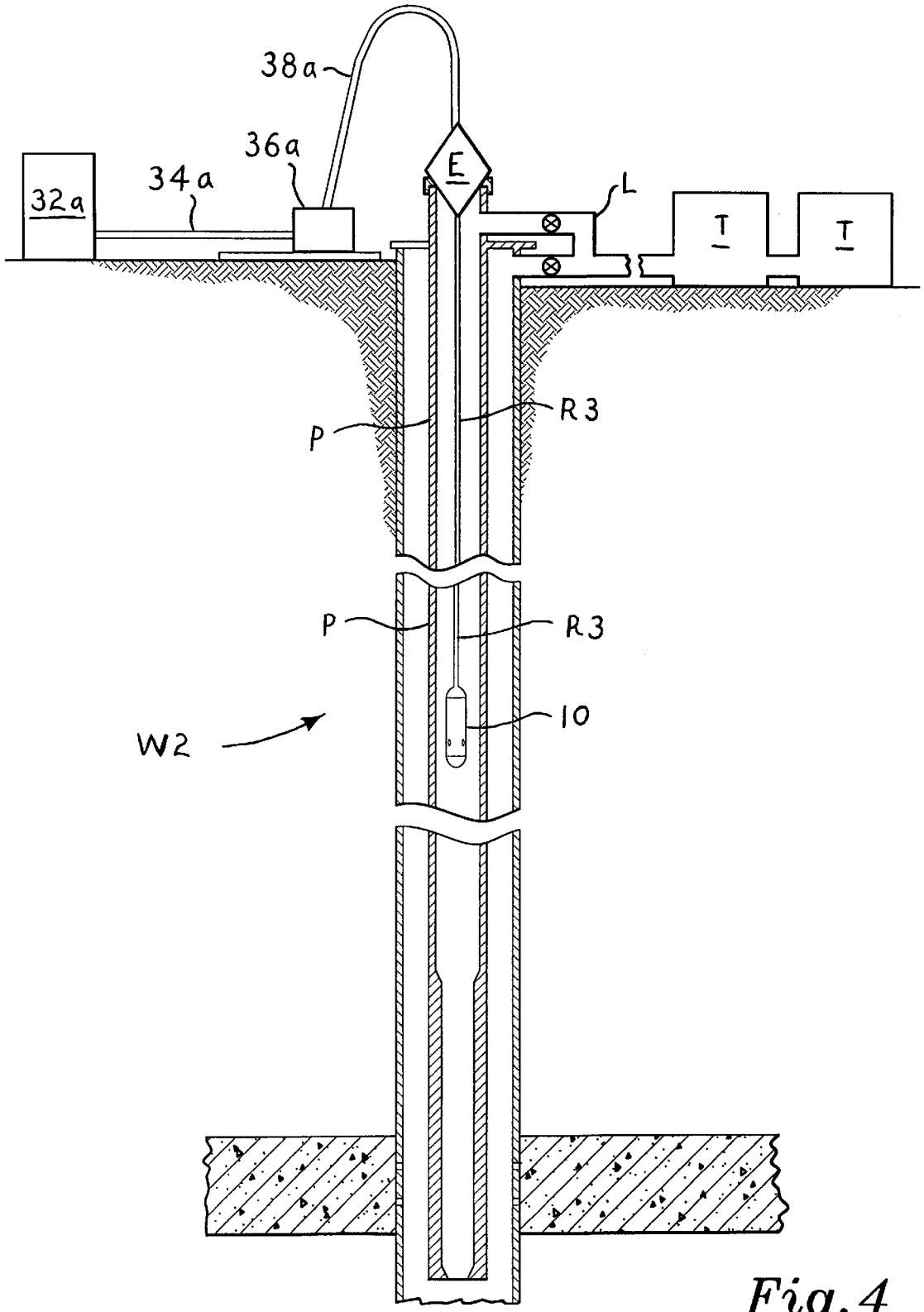
FIG. 4 is an environmental view in section of a pressure well with the present treatment tool installed therein.

FIGS. 3 and 4 disclose two different types of wells which might use the present tool 10 or any of its alternative embodiments. In FIG. 3, a pumping type well W1 is shown, with a downhole pump U installed in the bottom of the well W1. A sucker rod string, comprising an upper sucker rod portion R1 and a lower sucker rod portion R2, is installed generally concentrically down the production tube string P to actuate the pump U. The upper end of the string is alternately lifted by a well pump walking beam apparatus B, to cycle the pump U in the bottom of the well W1. Fluid pumped upwardly from the well W1 through the production tube string P exits the well at the wellhead H, where it is initially treated to separate water and gas therefrom and thence passed via delivery lines and control valves L to a battery of storage tanks T. All of the above described components are conventional.

However, a well treatment tool 10 is installed as a "sub," or shorter than standard length of sucker rod, between the upper and lower sucker rod string portions R1 and R2, at some predetermined depth in the well W1. In an oil and/or gas well, this depth is determined by the temperature in the well downhole, and is at a point where the temperature is at or slightly above the melting point of any paraffin issuing from the well. A point approximately three hundred feet below the paraffin solidification point has been found to be suitable. A treatment fluid storage tank 32 is provided at the surface, with a treatment fluid line 34 extending to a treatment fluid pump 36. (The pump 36 is shown at the walking beam B, but may be located at any practicable position, as desired.)

From the pump 36, the fluid is routed through a flexible high pressure line 38 (e. g., high pressure hydraulic hose, etc.) to accommodate the movement of the head of the walking beam apparatus. The line 38 is joined to the upper end of the sucker rod string at a connector 40. The treatment fluid or solvent is thus pumped downwardly into the downhole of the well W1, through the hollow core of the sucker rod Si, until it reaches the well treatment tool 10. The pump 36 pressure is increased to exceed the preset opening pressure of the valve spring 22 of the tool 10, whereupon the well treatment fluid is injected through the axial fluid entrance passage 18, past the valve 20, and outwardly through the radially disposed passage(s) 28 of the tool 10 into the production fluid passage F defined between the tool 10 and the production tube string P.

As the production fluid (oil, etc.) is carried upward through the production fluid passage F by the action of the downhole pump U, it will carry the well treatment fluid upwardly with it to flush or wash contaminants (e. g., paraffin buildup) from the internal walls of the production tube string P. Thus, the treatment fluid or solvent does not travel farther downwardly in the downhole of the well, where it might be lost between the production tube string and the outer downhole casing or sleeve, or perhaps be dissipated into the fluid or oil bearing strata at the bottom of the downhole. The present well treatment tool 10 ensures that all of the treatment fluid or solvent will be delivered only to those points and locations where it is needed.

Once the production fluid, with the well treatment fluid mixed therewith, leaves the wellhead H, it may be distributed to an initial treatment area, such as a heater treater (not shown), where the substance, e. g., crude oil, is heated to separate water and gas therefrom. The crude oil or other fluid is then placed in storage tanks T of a tank battery, as shown in FIGS. 3 and 4 and discussed further above. With the solvent fluid being mixed with the crude oil throughout the initial processing and storage steps, it will be seen that any paraffin will remain dissolved in a liquid state within the oil, even when the oil cools in the storage tank battery. Thus, the present invention serves to preclude the formation of paraffin solids not only in the well downhole, but throughout the above ground treatment and storage system.

The tool used to provide the above described benefits may comprise either the tool 10 of FIG. 1 or the tool 10*a* of FIG. 2, including their various components, e. g., an inlet port communicating with the hollow interior of the upper sucker rod string, a ball check or other suitable valve communicating with the inlet port, and a valve outlet which communicates with one or more fluid outlet ports radially disposed from the body of the tool. The tool 10 or 10*a* is installed in the sucker rod string as described further above, by means of the externally or internally threaded ends, respectively of tools 10 or 10*a*, and a suitable coupling C. Again, tools of the present invention may be fabricated having one internally threaded end and an opposite externally threaded end to eliminate the need for a coupling.

FIG. 4 discloses a tool 10 or 10*a* installation in a flowing or artesian well W2, where subterranean pressure is sufficient to deliver the production fluid from the well without need for any pump means. Such wells W2 are generally capped, and may have a lubricator E installed at the wellhead, as shown schematically in FIG. 4. In such flowing wells W2, no pump is required at the bottom of the well, and thus no pump operating apparatus is required at the surface. This precludes any requirement for a sucker rod string installation in the production tube string P, but a partial sucker rod string R3 is installed through the lubricator E in order to suspend a well treatment tool, e. g., tool 10, at a predetermined depth within the well W2. As no pump is installed at the bottom of the downhole, no lower sucker rod string portion need extend below the tool 10 within the production tube string P.

Operation of the tool 10 (or 10*a*, depending upon the specific configuration of the threaded sucker rod ends, and couplings required) is essentially the same as that described above for the tool 10 of the pumping well W1 of FIG. 3. Treatment fluid is delivered from a storage tank 32*a* to a treatment fluid pump 36*a* via a delivery line 34*a*, and thence to the upper sucker rod string R3 by means of a high pressure line 38*a*. Treatment fluid travels downwardly through the upper sucker rod string R3, until it reaches the tool 10 or 10*a* installed at the lower end thereof. The fluid then passes through the internal valve mechanism of the tool when sufficient pressure is provided by the treatment fluid pump 36*a* at the surface, to be distributed from the tool into the production fluid.

The treatment fluid or solvent then mixes with the production fluid in the fluid passage F between the tool 10 or 10*a* and the surrounding production tube string P, as in the case of the pumped well W1. Delivery of the mixed production and treatment fluids to the surface for further processing and storage is essentially identical to that described above for the pumped well W1, with the fluid mixture being delivered to an initial treatment area (not shown) and thence to a battery of storage tanks T via delivery lines and valves L. The mixture of paraffin solvent with crude oil serves to preclude the paraffin from settling out of solution with the oil as it cools in the storage tanks, thus obviating any periodic need to clean out the paraffin buildup in the bottoms of the storage tanks T.

In summary, the present well treatment tools 10 and 10*a* will be seen to provide a much needed means of providing simultaneous treatment for a producing well, without need to shut down well production for treatment. The present tool 10 may be operated continuously, if needed, but treatment may be provided on an intermittent basis as required or desired, merely by operating the treatment fluid pump at the surface accordingly. The present well treatment tool and system could be configured to operate automatically, if desired, by means of pressure or flow transducers in the output lines. If a drop in pressure or flow is detected, a signal could be sent to operate the treatment fluid pump to clear any paraffin or other buildup until normal well output pressure or flow is obtained, whereupon the treatment pump is stopped.

While the structure and function of the present invention has been described generally in connection with subterranean fluid wells of various types (water, oil, etc.), it should be noted that the present tool embodiments are of particular value in the oil industry for the elimination of paraffin buildup along the internal walls of the production tube string in such a well, as described further above. The treatment of the oil from a point before or below that at which the paraffin begins to solidify, throughout the remainder of the surface treatment and storage system at the well, ensures that well production will be maintained and that downtime for cleanout and treatment of paraffin residue in the surface system will be eliminated. Thus, the present tools 10 and 10*a* will be seen to pay for themselves in short order in the oil industry, and their usefulness in other subterranean fluid well treatment fields will be appreciated as well.

It is to be understood that the present invention is not limited to the sole embodiments described above, but encompasses any and all embodiments within the scope of the following claims.

I claim:

1. A well treatment tool, comprising:

a generally cylindrical body for installing concentrically in line with a sucker rod string disposed generally concentrically within a production tube string and for distributing well treatment fluid from the sucker rod string and into the production tube string, with at least the portion of the sucker rod string disposed above said cylindrical body being hollow;

said body including an upper end having an axial fluid entrance passage therein for accepting treatment fluid from the sucker rod portion disposed thereabove, and an opposite solid lower end;

said body further including at least one treatment fluid distribution passage extending outwardly from said body;

valve means disposed within said body;

said valve means including an inlet end communicating with said fluid entrance passage and opposite outlet end communicating with said fluid distribution passage; and attachment means disposed upon said upper end and said lower end of said body, for attaching said body to the sucker rod string.

2. The well treatment tool according to claim 1, wherein the production tube string has an internal diameter, and said body has a maximum diameter smaller than the internal diameter of the production tube string to define a production fluid passage therebetween.

3. The well treatment tool according to claim 1, wherein said valve means comprises a normally closed ball check valve.

4. The well treatment tool according to claim 1, wherein said at least one treatment fluid distribution passage comprises a plurality of radially disposed passages extending from said outlet end of said valve, outwardly through said body.

5. The well treatment tool according to claim 1, wherein said upper end and said lower end are externally threaded.

6. The well treatment tool according to claim 1, wherein said upper end and said lower end are internally threaded.

7. A producing well having at least a production tube string and a sucker rod string disposed generally concentrically therein and, comprising in combination:

a well treatment tool having a generally cylindrical body for installing concentrically in line with said sucker rod string and for distributing well treatment fluid from said sucker rod string and into said production tube string, with said sucker rod string including at least a hollow portion disposed above said cylindrical body;

said body of said well treatment tool including an upper end having an axial fluid entrance passage therein for accepting treatment fluid from said sucker rod portion disposed thereabove, and an opposite solid lower end;

said body of said well treatment tool further including at least one treatment fluid distribution passage extending outwardly from said body of said well treatment tool;

valve means disposed within said body of said well treatment tool;

said valve means including an inlet end communicating with said fluid entrance passage and opposite outlet end communicating with said fluid distribution passage; and attachment means disposed upon said upper end and said lower end of said body of said well treatment tool, for attaching said body to said sucker rod string.

8. The producing well and well treatment tool combination according to claim 7 wherein said production tube string has an internal diameter, and said body of said well treatment tool has a maximum diameter smaller than said internal diameter of said production tube string to define a production fluid passage therebetween.

9. The producing well and well treatment tool combination according to claim 7, wherein said valve means of said well treatment tool body comprises a normally closed ball check valve.

10. The producing well and well treatment tool combination according to claim 7, wherein said at least one treatment fluid distribution passage of said well treatment tool body comprises a plurality of radially disposed passages extending from said outlet end of said valve, outwardly through said body.

11. The producing well and well treatment tool combination according to claim 7, wherein said upper end and said lower end of said well treatment tool body are externally threaded.

12. The producing well and well treatment tool combination according to claim 7, wherein said upper end and said lower end of said well treatment tool body are internally threaded.

13. A method of treating a producing well having at least a production tube string with a hollow length of sucker rod string disposed generally concentrically therein, with the production tube string having a production fluid flowing upwardly therethrough to an initial treatment and storage system, the method comprising the following steps:

(a) providing a well treatment tool having a generally cylindrical body, an upper end having an axial fluid entrance passage therein for accepting well treatment fluid from the sucker rod portion disposed thereabove, an opposite solid lower end, and at least one treatment fluid distribution passage extending outwardly from the body;

(b) installing the tool concentrically in line with the sucker rod string at a predetermined depth in the well, with the fluid entrance passage communicating with the interior of the hollow sucker rod string;

(c) dispensing a well treatment fluid under pressure downwardly from the surface, through the sucker rod string to the well treatment tool;

(d) distributing the well treatment fluid from the treatment fluid distribution passage of the well treatment tool, into the production tube string; and (e) flushing the well treatment fluid upwardly with the production fluid, through the production tube string and into the initial treatment and storage system.

14. The method of treating a producing well according to claim 13, including the step of providing a valve disposed within the body, with the valve including an inlet end communicating with the fluid entrance passage of the body and opposite outlet end communicating with the fluid distribution passage.

15. The method of treating a producing well according to claim 14, including the step of providing a normally closed ball check valve for the valve.

16. The method of treating a producing well according to claim 13, including the steps of:

(a) defining an internal diameter for the production tube string;

(b) providing a maximum diameter for the body of the well treatment tool, less than the internal diameter of the production tube string; and (c) defining a production fluid passage between the internal diameter of the production tube string and the body of the well treatment tool.

17. The method of treating a producing well according to claim 13, including the step of providing a plurality of radially disposed treatment fluid distribution passages extending from said outlet end of the valve, outwardly through the body.

18. The method of treating a producing well according to claim 13, including the step of providing externally threaded ends for removably attaching the upper end and the lower end of the well treatment tool to the sucker rod string.

19. The method of treating a producing well according to claim 13, including the step of providing internally threaded ends for removably attaching the upper end and the lower end of the well treatment tool to the sucker rod string.

20. The method of treating a producing well according to claim 13, including the steps of:

(a) providing oil with a paraffin component mixed therein as the production fluid; and (b) providing a paraffin solvent as the well treatment fluid.

* * * * *